US005660348A

United States Patent [19]

Sansone et al.

[11] Patent Number: 5,660,348

[45] Date of Patent: Aug. 26, 1997

[54] COMPUTER CONTROLLED FILAMENT WINDING SYSTEM HAVING TENSIONING DEVICE

[75] Inventors: Louis E. Sansone, Brooklyn; Barry A. Blakely, Baltic, both of Conn.

[73] Assignee: The United States of America as represented by the Secretary of the Navy, Washington, D.C.

[21] Appl. No.: 530,392

[22] Filed: Sep. 19, 1995

[51] Int. Cl.[6] ..... B21F 17/00

[52] U.S. Cl. ..... 242/439; 242/419.8; 242/441.1; 242/448.1

[58] Field of Search ..... 242/439, 441.1, 242/441.4, 448.1, 419.7, 419.8

[56] References Cited

U.S. PATENT DOCUMENTS

| | | | |
|---|---|---|---|
| 2,393,548 | 1/1946 | McCoy | 242/448.1 X |
| 3,380,675 | 4/1968 | Baxter, Jr. et al. | 242/441.1 X |
| 4,928,560 | 5/1990 | Vives et al. | 242/439 |
| 5,314,565 | 5/1994 | Moore | 242/441.1 X |

*Primary Examiner*—Daniel P. Stodola

*Assistant Examiner*—Emmanuel M. Marcelo

*Attorney, Agent, or Firm*—Michael J. McGowan; Prithvi C. Lall; Michael F. Oglo

[57] ABSTRACT

An apparatus for winding fine filaments onto stationary long rods includes a supporting base having control mounting and filament mounting regions. The filament winding region includes first and second parallel bearing rods on which are slidably mounted a filament winding region traversing base member. The traversing base member traverses along the first and second parallel bearing rods at a selectable rate of speed as moved by a coupled mechanism. A filament winding head is mounted to the traversing base member and rotated about the long rod which passes through a cylindrical passageway in the filament winding head. A spool of fine filament is mounted on the filament winding head concentric with the cylindrical passageway in the filament winding head and the long rod, for dispensing fine filament from the spool onto the long rod. Also provided are a controller mechanism, coupled at least to the mechanism for effecting traversing movement of the traversing base member and for establishing the selectable rate of speed at which the traversing base member including the filament winding head and spool of fine filament traverses the winding region about the stationary long rod, for controlling and establishing a winding profile of the fine filament onto the long rod.

12 Claims, 2 Drawing Sheets

COMPUTER CONTROLLED FILAMENT WINDING SYSTEM HAVING TENSIONING DEVICE

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

1. Field of the Invention

The present invention is directed towards a system for controlling and providing precision winding of delicate fibers, such as optical fibers, onto long rods or mandrels.

2. Description of the Prior Art

The wrapping of relatively short rods or mandrels (under 6 feet) has been accomplished by prior art devices. Such devices typically rotate the rod while the fiber is made to traverse the length of the rod.

The known devices are limited to wrapping only such relatively short rods, however, due to the inherent flexibility or "sag" of the rods. Rods longer than 6 feet generally exhibit significant "sag" which results in a filament winding that is inaccurate in both tension uniformity and spatial placement on the rod. Therefore, only relatively short rods may be wrapped with any precision utilizing the known devices.

Several applications, such as for fiber optic hydrophones, require that very thin fiber optic filaments be precisely wound with an accuracy of +/−0.1 mm with light tensioning in the range of 0 to 500 grams (with +/−5 grams resolution) on very long rods (over 10 feet). Light tensioning is required to control the amount of stretch in the fiber, and to prevent unraveling of the filament on the spool when the machine is stopped. Currently, a system to provide such results is not known.

SUMMARY OF THE INVENTION

Accordingly, this invention features an apparatus for precisely winding fine filaments onto a stationary long rod. The apparatus includes a supporting base having a control mounting region and a filament mounting region. The control mounting region provides an area on which may be mounted control apparatus, such as a computer, to control the winding of the fine filament onto the long rods. Utilizing the control apparatus to vary the speed of traverse of the winding mechanism as well as the rotational speed of the winding head, an unlimited number of filament winding profiles may be established.

The supporting base portion of the present apparatus also includes a filament winding region which includes first and second parallel bearing rods disposed in spaced parallel relationship to one another. A filament winding region traversing base member is slidably coupled to the first and second parallel bearing rods, and adapted for traversing the filament winding region in first and second opposite directions along the first and second parallel bearing rods and parallel to the bearing rods. The traversing base member is coupled to means for causing the traversing base member to traverse the filament winding region of the supporting base member along the first and second parallel bearing rods at a selectable rate of speed.

The traversing base member also includes a filament winding head which is adapted for rotational movement about an axis parallel to the first and second parallel bearing rods and about the long rod onto which the filament is being wound. The filament winding head moves rotationally while the traversing base member traverses the filament winding region. The filament winding head further includes a central cylindrical passageway which passes through the filament winding head and which is concentric with the long rod onto which the fine filament is to be wound, for slidably receiving the long rod and for supporting the rod proximate a region of the long rod onto which the fine filament is presently being wound.

The filament winding head is coupled to means, such as a motor, for effecting rotational movement of the filament winding head.

The present apparatus also includes a spool of fine filament, fixably mounted to the filament winding head and concentric with the long rod onto which the fine filament is to be wound. The spool of fine filament rotates with the filament winding head and traverses the rod while the traversing base member traverses the filament winding region, for dispensing the fine filament from the spool onto the long rod.

Additionally, the present invention includes means for controlling the means for causing the traversing base member to traverse the filament winding region and the means for effecting rotational movement of the filament winding head, for controlling both the traversing movement and the rotational movement of the traversing base member and filament winding head respectively, for establishing and controlling a winding profile of the fine filament onto the long rod.

In the preferred embodiment, the controller means controls both the rotational speed of the filament winding head and the selectable rate of speed at which the traversing base member traverses the filament winding region, for establishing the winding profile of the fine filament onto the long rod. The traversing movement of the traversing base member may be effected by a lead screw coupled to a selectably controllable stepper motor. The lead screw connects to the traversing base member for effecting a traversing movement in the traversing member.

In the preferred embodiment, the traversing base member further includes at least first and second long rod support members, slidably coupled to and supported concentrically about the long rods, for supporting the long rods proximate the filament winding head. The preferred embodiment also includes a mechanism for adjusting the tension applied to the fine filament being wound onto the long rod.

The preferred embodiment also includes means for maintaining the spool of fine filament tensioned on the filament winding head including a felt washer spaced between the spool of fine filament and a backing plate on the filament winding head, as well as an internally threaded tension ring which axially secures the spool of fine filament onto the filament winding head between the backing plate and the internally threaded tension ring. The internally threaded tension ring threads on the exterior of the cylindrical passageway formed in the filament winding head. Also included may be a thrust washer and spring washer coupled proximate the internally threaded tension ring, for frictionally holding said spool of fine filament onto the filament winding head.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing wherein.

DESCRIPTION OF THE PREFERRED EMBODIMENT

Figure 1:
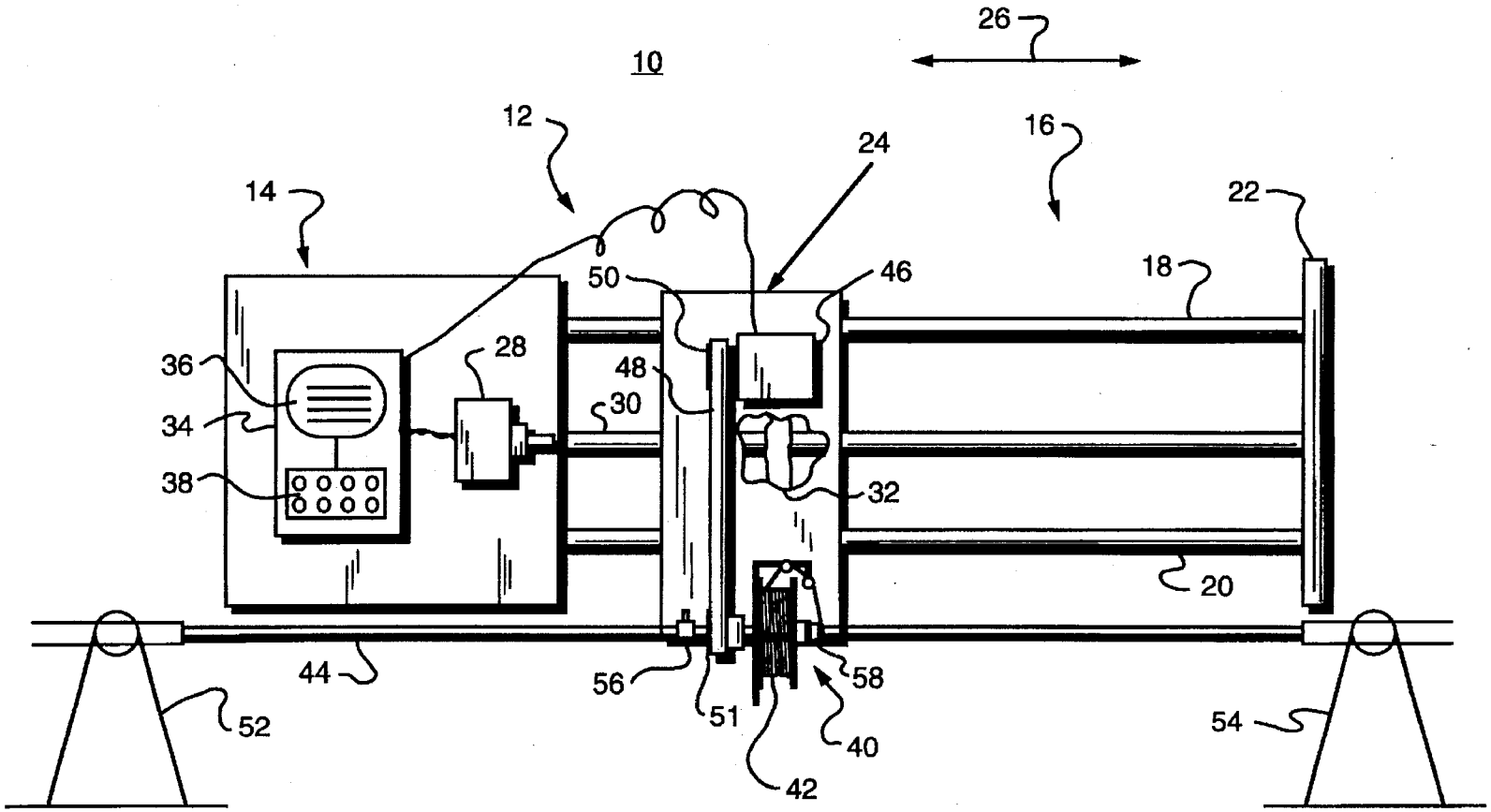
FIG. 1 is schematic representation of the apparatus for winding fine filaments onto stationary long rods according to the present invention.

The apparatus for winding fine filaments onto stationary long rods according to the present invention is shown generally at 10, FIG. 1 and comprises a supporting base 12 including a controller mounting region 14 and a filament winding region 16. The filament winding region includes at least first and second parallel bearing rods 18 and 20. The first and second parallel bearing rods 18, 20 are disposed in spaced parallel relationship and supported by the base member proximate a first end at controller 14, and proximate a second end nearby supporting structure 22.

A filament winding region traversing base member 24 is slidably coupled to the first and second parallel bearing rods 18, 20. The traversing base member 24 uses a standard canted roller assembly to facilitate movement of the traversing base member 24 down the filament winding region 16 in the direction indicated generally by arrow 26. Such canted roller assemblies are well known to those skilled in the art.

Movement of the traversing base member 24 across the filament winding region is provided by a mechanism such as a stepper motor 28 disposed on the control region 14 of the base 12. Stepper motor 28 is coupled to lead screw 30 which is a threaded type rod, which passes through an internally threaded connecting element 32 coupled to the traversing base member 24.

In such a system, rotation of the lead screw under control of stepper motor 28 causes movement of the traversing base member 24 in either the forward or reverse direction indicated generally by arrow 26. Stepper motor 28 is coupled to controller 34 which in the preferred embodiment includes a computer system including monitor and keyboard 36, 38, respectively, which allows the system operator to program the traverse rate of the traversing base member 24 by controlling the stepper motor 28. Controller 34 is also adapted to control the rotation of the filament winding head as will be explained in greater detail below.

The traversing base member 24 of the present invention also includes a filament winding head 40 coupled to the traversing base member. The filament winding head includes a spool of fine filament 42 which is to be wound onto long rod 44. The filament winding head 40 includes a central region which forms a cylindrical passageway which has a diameter large enough to accommodate the stationary long rod 44. The spool of fine filament 42 also includes a central, annular shaped region having a diameter large enough to accommodate being placed over the central cylindrical passageway of the filament winding head 40. Thus, the long rod 44, filament winding head 40 and spool of fine filament 42 are concentric with one another.

The filament winding head 40 is coupled to a mechanism such as motor 46 by means of a belt 48 and first and second pulleys 50, 51, which serve to rotate the filament winding head at a predetermined speed. Motor 46 is preferably coupled to controller 34, which allows the operator to control the rate of rotation of the filament winding head 40. Thus, controller 34 of the present invention is adapted to track both the rotational speed of the filament winding head as well as the position of the filament winding head on the traversing base member 24. Controller 34 may adjust the rate of rotation of the filament winding head and/or the rate of traverse of the traversing base member 24 as often as after each filament winding head rotation. Such control allows for very complex filament winding profiles to be accomplished.

Additionally, since the traverse rate of the traversing base member 24 is determined only by the speed of rotation of the stepper motor 28 and not by a variable cant angle of a roller assembly as in many prior art mechanisms, small traverse rates and high resolution (less than 0.5 mm rate and less than 0.1 mm resolution) are possible utilizing the apparatus of the present invention.

An additional feature of the present invention is the central cylindrical passageway of the filament winding head 40 which is concentric with the long rod 44. This allows the long rod 44 to remain stationary, held in place by at least first and second support stands 52, 54. Since the long rod 44 does not rotate, sag of the rod is not a concern and very long rods (over six feet) may be wound. Indeed, the only limitation on the length of the rod onto which fine filament may be wound is the length of the room or facility which houses the apparatus of the present invention.

Typically, the rods or mandrels are fabricated of a material such as plastic, teflon, polycarbonate or nylon and range from ¼ inches in diameter to ⅝ inches in diameter. An additional feature of the present invention is the provision of first and second rod supports 56, 58 located proximate opposite sides of the filament winding head 40. The first and second rod supports 56, 58 serve to support the long rod 44 proximate the filament winding head 40 to insure that the rod is held in the proper position, without sag, in the immediate vicinity of the winding head, and to therefore insure that the filament is accurately wound onto the rod.

Figure 2:
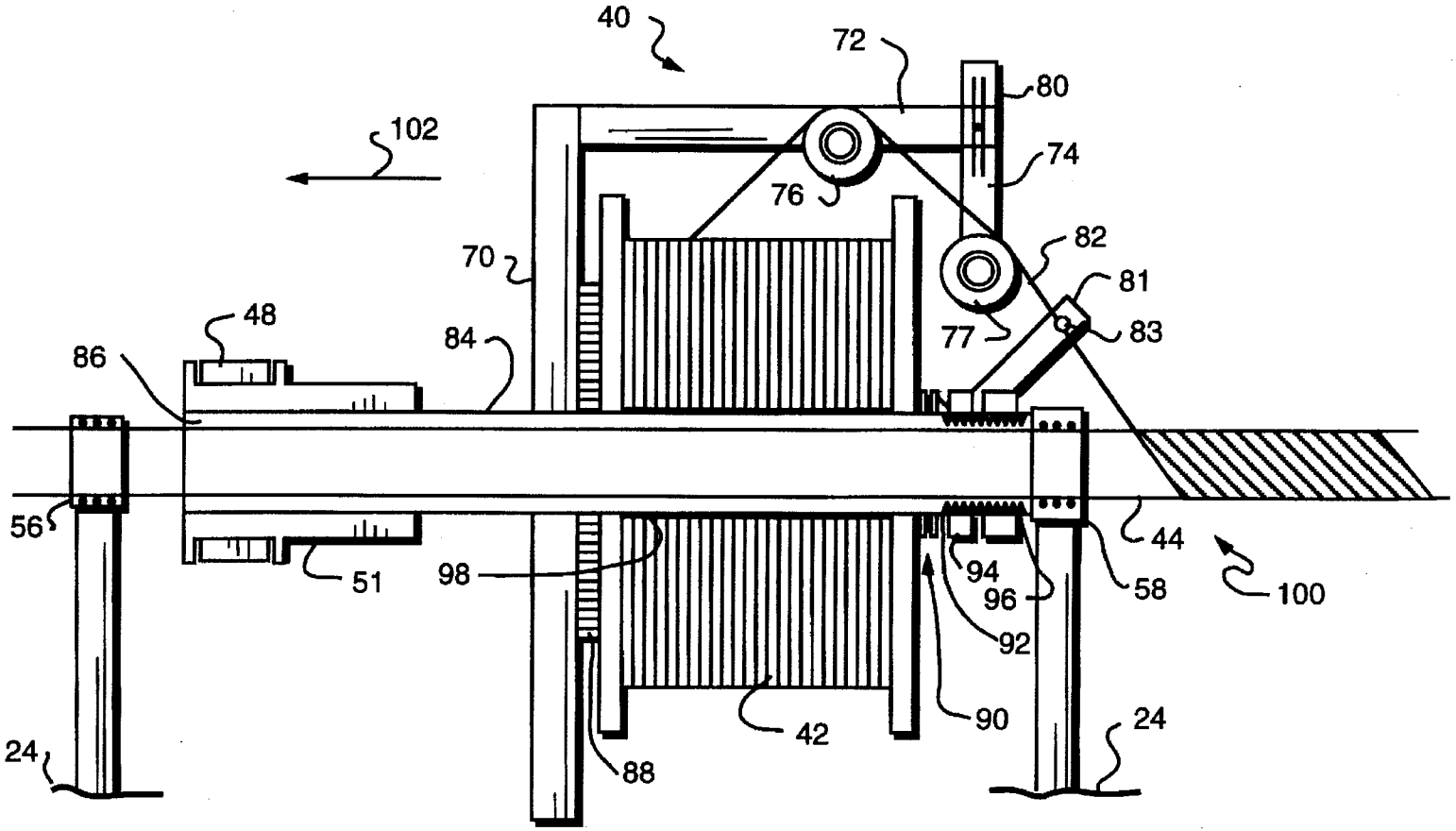
FIG. 2 is a more detailed illustration of the filament winding head including a mounted spool of fine filament and long rod support members according to the present invention.

A more detailed view of the filament winding head 40 is shown in cross section in FIG. 2 wherein the filament winding head 40 is shown to include a filament spool backing plate 70 with first and second supporting arms 72, 74 supporting filament guide pulleys 76, 77. The second support arm 74 is adjustable by means of adjustment slot 80 to facilitate adjusting the tension on the filament 82 being wound onto the long rod 44. Initially, filament tension measurement is performed utilizing a hand held tensioner. By moving adjustment arm 74, variable tension may be applied to the filament being wound. In this manner, precise and light tensioning of delicate filaments, such as fiber optic filaments, may be achieved with a tension range of 0 to 500 grams, +/−5 grams resolution. Light tensioning is necessary in order to control the amount of stretch in the filament, and to prevent unraveling of the filament when the winding head is stopped.

Backing plate 70 of the filament winding head 40 is coupled to shaft 84 which includes a central cylindrical passageway 86, previously described, into which may be inserted long rod 44. Pulley 51 which allows engagement with drive belt 48 connected to a drive motor (not shown in this Fig. but previously described) provides rotational movement to the filament winding head. Guide arm 81 including eyelet 83, guides the filament 82 onto the rod 44.

The present invention also features a simple and predictable spool tensioning system which holds the spool 42 of fine filament onto the filament winding head 40. The tensioning system includes a felt washer 88 disposed between the filament spool 42 and the filament winding head backing plate 70. In addition, a thrust washer 90 proximate a preload washer 92 are held against the filament spool 42 by means of a tension adjustment locking ring 94 threaded onto the threads 96 of shaft 84. Optionally, a nylon tube 98 may be interposed between the filament spool 42 and the filament winding head shaft 84.

Long rod 44 is supported proximate the filament winding head and in particular, proximate the region 100 at which the filament 82 is being wound onto the long rod by means of a first rod support bearing 58 which is coupled to the traversing base member 24 as well as by a second rod support bearing 56 also coupled to the traversing base member 24. Thus, when in use, the filament winding head 40 traverses the filament winding region and the long rod in the direction indicated generally by arrow 102, while the first and second long rod guide bearings 56, 58 precisely support the rod 44 in the filament winding region 100, to ensure precise winding of the filament onto the rod.

Accordingly, Applicants have provided a reliable filament winding apparatus which easily and accurately provide for the winding of fine filaments having varying diameters onto long rods (over six feet in length), with the only length limitation of the rod being that of the facility in which the winding is being performed.

In light of the above, it is therefore understood that within the scope of the appended claims, the invention may be practiced otherwise than as specifically described.

What is claimed is:

1. Apparatus for winding fine filaments onto stationary long rods, comprising:

a supporting base including a control mounting region and a filament winding region, said filament winding region supporting and including first and second parallel bearing rods, said first parallel bearing rod disposed in spaced parallel relationship to said second parallel bearing rod;

a filament winding region traversing base member, slideably coupled to said first and second parallel bearing rods, and adapted for traversing said filament winding region of said supporting base along said first and second parallel bearing rods parallel to a longitudinal axis that passes through said first and second parallel bearing rods;

a filament winding head, mounted on said traversing base member, and adapted for rotational movement about an axis parallel to said longitudinal axis that passes through said first and second parallel bearing rods while said traversing base member traverses said filament winding region, said filament winding head including: a tubular body portion forming a cylindrical passageway for receiving said long rod and forming an axle for rotatably mounting said spool of fine filament thereon; a backing plate portion orthogonal to a longitudinal axis that passes through said long rod; and a tension adjustment locking ring adapted to be received on said tubular body portion for axially securing said spool of filament on said tubular body portion proximate said backing plate by means of friction created between said spool and said backing plate created by tightening said tension adjustment locking ring against said spool of fine filament;

means, coupled to said traversing base member, for effecting traversing movement of said traversing base member in first and second opposite directions, said first and second opposite directions parallel to said longitudinal axis that passes through said first and second parallel bearing rods, said means for effecting traversing movement adapted for causing said traversing base member to traverse said filament winding region of said supporting base along said first and second parallel bearing rods at a selectable rate of speed;

means, coupled to said filament winding head, for effecting rotational movement of said filament winding head;

a spool of fine filament, fixably mounted to said rotating filament winding head and concentric with said long rod, said spool of fine filament rotating with said filament winding head and traversing said rod while said traversing base member traverses said filament winding region, for dispensing said fine filament from said spool onto said long rod; and controller means, coupled to at least said means for effecting traversing movement of said traversing base member, for controlling said means for effecting traversing movement and for establishing said selectable rate of traverse at which said traversing base member including said rotating filament winding head traverses said filament winding region and said long rod, for controlling a winding profile of said fine filament onto said long rod.

2. The apparatus of claim 1, wherein said controller means is coupled to said means for effecting rotational movement of said filament winding head, for controlling rotational speed of said filament winding head.

3. The apparatus of claim 2, wherein said controller means adjusts at least one of said rotational speed of said filament winding head and said selectable rate of traverse of said traversing base member, for controlling said winding profile of said fine filament onto said long rod.

4. The apparatus of claim 3, wherein said controller means includes a computer.

5. The apparatus of claim 1, wherein said means for effecting traversing movement of said traversing base member includes a lead screw and a selectively controllable stepper motor.

6. The apparatus of claim 1, wherein said traversing base member includes at least first and second long rod support members, said first long rod support member disposed concentrically about said long rod and coupled to said traversing base member proximate a first side of said filament winding head, said second long rod support member disposed concentrically about said long rod and coupled to said traversing base member proximate a second side of said filament winding head, diametrically opposed from said first side of said filament winding head and said first long rod support member.

7. The apparatus of claim 1, wherein said filament winding head includes means for winding said fine filament onto said long rod under a predetermined amount of tension.

8. The apparatus of claim 7, further including means for selectively controlling said predetermined amount of tension.

9. The apparatus of claim 8, wherein said means for selectably controlling said predetermined amount of tension includes at least first and second guide pulleys.

10. The apparatus of claim 1 wherein said winding head further comprises:

a felt washer disposed between said spool of fine filament and said backing plate;

a thrust washer between said spool and said tension adjustment locking ring; and a spring washer disposed between said thrust washer and said tension adjustment locking ring, to provide an adjustable axial pre load force for rotatably holding said spool under friction between said thrust washer and said backing plate.

11. The apparatus of claim 1 wherein said filament winding region traversing base member includes a motor, a pulley mounted on an output shaft of said motor, a pulley coupled to said tubular body portion of said filament winding head, and a belt mounted on said pulley on said output shaft of said motor and on said pulley on said tubular body portion to effect rotational movement of said filament winding head.

12. A filament winding head, for winding fine filaments onto stationary long rods, said filament winding head comprising:

a body portion forming a passageway for receiving said long rod;

a backing plate coupled to said body portion substantially orthogonal to said body portion and to a longitudinal axis that passes through said long rod;

a spool of fine filament, mounted to said body portion, for rotating around said long rod;

a felt washer disposed on said body portion between a first end of said spool of fine filament and said backing plate;

a thrust washer disposed on said body portion proximate a second end of said spool of fine filament;

a preload washer disposed on said body portion proximate said thrust washer; and a tension adjustment locking ring engaged with said body portion proximate said preload washer, for tightening and axially securing said spool of fine filament on said body portion, wherein said felt washer, said thrust washer, said preload washer, and said tension adjustment locking ring cooperate to adjust the tension of said winding head by adjusting a friction fit between said spool of fine filament and said backing plate coupled to said body portion.

* * * * *